US008919311B2

(12) United States Patent
Flynn et al.

(10) Patent No.: US 8,919,311 B2
(45) Date of Patent: Dec. 30, 2014

(54) METHOD AND SYSTEMS FOR VARIABLE VALVE TIMING FOR A V-ENGINE WITH A SINGLE CENTRAL CAMSHAFT

(71) Applicant: General Electric Company, Schenectady, NY (US)

(72) Inventors: Paul Lloyd Flynn, Lawrence Park, PA (US); Ganesha Koggu Naik, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/786,530

(22) Filed: Mar. 6, 2013

(65) Prior Publication Data

US 2014/0251246 A1 Sep. 11, 2014

(51) Int. Cl.
*F01L 1/18* (2006.01)
*F01L 1/34* (2006.01)

(52) U.S. Cl.
CPC ..... *F01L 1/34* (2013.01)
USPC ..... 123/90.44; 123/90.16; 123/90.27; 123/90.31; 123/90.39

(58) Field of Classification Search
USPC ..... 123/90.39, 90.44, 90.16, 90.27, 90.31
See application file for complete search history.

(56) References Cited

U.S. PATENT DOCUMENTS

| | | | | |
|---|---|---|---|---|
| 1,524,150 | A | 1/1925 | Rhoads | |
| 2,851,023 | A | 9/1958 | Durkan | |
| 2,856,909 | A | 10/1958 | Turlay | |
| 4,452,198 | A | 6/1984 | Berland | |
| 4,527,518 | A | 7/1985 | Osaki et al. | |
| 4,697,554 | A | 10/1987 | Bothwell | |
| 6,390,046 | B1 | 5/2002 | Sweetland | |
| 6,988,473 | B2 * | 1/2006 | Rohe et al. | 123/90.16 |
| 7,171,929 | B2 | 2/2007 | Dosdall et al. | |
| 7,404,386 | B1 * | 7/2008 | Raghavan et al. | 123/90.39 |
| 7,603,973 | B2 | 10/2009 | Flierl et al. | |
| 7,849,828 | B2 * | 12/2010 | Elnick et al. | 123/90.39 |
| 8,069,829 | B2 | 12/2011 | Leone | |
| 2009/0145382 | A1 | 6/2009 | Kawai | |
| 2011/0132300 | A1 | 6/2011 | Mondini et al. | |

FOREIGN PATENT DOCUMENTS

| | | | |
|---|---|---|---|
| GB | 144760 | A | 6/1920 |
| RU | 2476691 | C2 | 2/2013 |

OTHER PUBLICATIONS

Eurasian Search Report issued in connection with corresponding EA Application No. 201490349 on Jun. 2, 2014.

* cited by examiner

*Primary Examiner* — Ching Chang
(74) *Attorney, Agent, or Firm* — GE Global Patent Operation; John A. Kramer

(57) ABSTRACT

Various methods and systems are provided for varying valve timing in a V-engine. In one embodiment, a method for an engine comprises pivoting a first cam follower for a first cylinder of a first bank and a second cam follower for a second cylinder of a second bank about a rotatable pivot shaft, driving the first cam follower and the second cam follower with a camshaft to operate a respective first valve of the first cylinder and a second valve of the second cylinder, and rotating the pivot shaft to vary a valve timing of the first cylinder and the second cylinder.

20 Claims, 8 Drawing Sheets

METHOD AND SYSTEMS FOR VARIABLE VALVE TIMING FOR A V-ENGINE WITH A SINGLE CENTRAL CAMSHAFT

FIELD

Embodiments of the subject matter disclosed herein relate to a V type engine, engine components, and an engine system, for example.

BACKGROUND

Diesel and gasoline V-engines utilize intake and exhaust valves to control intake air entering engine cylinders for combustion and exhaust gases exiting the engine cylinders after combustion. The timing of opening and closing of these valves may affect the amount of air available for combustion and the power output and $NO_x$ production of the engine. As such, intake and exhaust valve events may be optimized to reduce emissions and improve fuel consumption. However, if valve timing is optimized for high loads, the acceleration performance of the engine at low loads may suffer.

In one example, various hydraulic and electrical variable valve timing mechanisms may provide variable valve timing at different engine operating conditions. However, these systems may require complicated control mechanisms and comprise many components.

BRIEF DESCRIPTION

In one embodiment, an engine method (e.g., method for controlling an engine) comprises pivoting a first cam follower for a first cylinder of a first bank and a second cam follower for a second cylinder of a second bank about a rotatable pivot shaft, driving the first cam follower and the second cam follower with a camshaft to operate a respective first valve of the first cylinder and a second valve of the second cylinder, and rotating the pivot shaft to vary a valve timing of the first cylinder and the second cylinder.

In one example, a pivot shaft coupled to a series of cam followers may be used to adjust the timing of when a lobe of a camshaft contacts a cam follower and actuates an intake or exhaust valve coupled through a pushrod to the cam follower, thereby adjusting the timing of the valve. By rotating the pivot shaft, valve timing on a left and right bank of cylinders of the V-engine may be adjusted. In this way, timing of the intake and/or exhaust valves of the V-engine may be adjusted at different engine operating conditions with the pivot shaft and a single, central camshaft.

In another embodiment, a system for an engine comprises a V-engine with a single, central camshaft, a rotatable pivot shaft offset from the camshaft, a first group of cam followers driven by the camshaft and pivoted about the rotatable pivot shaft, and a first group of pushrods operative to drive valves of a first cylinder group. The first group of pushrods is operatively coupled with the first group of cam followers. The system further comprises a second group of cam followers driven by the camshaft and pivoted about the rotatable pivot shaft, and a second group of pushrods operative to drive valves of a second cylinder group. The second group of pushrods is operatively coupled with the second group of cam followers.

In this way, valve timing of intake and exhaust valves on a first bank of cylinders and a second bank of cylinders may be adjusted with the same pivot shaft and a single camshaft. Further, by rotating the pivot shaft during different engine operating conditions, valve timing may be optimized for increased engine performance.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of a cam follower system to vary valve timing in a V-engine. The cam follower system may include a single camshaft centralized between two banks of cylinders in the V-engine. For each intake and exhaust valve of each cylinder, a cam follower or rocker may be coupled to the valve. A cam follower may be driven by the camshaft, actuating the valve as a cam lobe on the camshaft contacts one end of the cam follower. Each cam follower may be coupled at another end to an eccentric pivot point on a pivot shaft. The pivot points may be offset from a main axis of the pivot shaft. As such, rotating the pivot shaft may translate the position of the pivot points, thereby shifting the position of the cam followers and the point at which they contact the camshaft. This shifting the position of the cam followers may cause valve timing to be adjusted. Depending on the amount of pivot points and the location of the pivot points relative to the pivot shaft, the timing of the intake and/or exhaust valves may be adjusted by rotating a single pivot shaft. In one example, a controller may adjust the pivot shaft to adjust valve timing based on engine operating conditions. For example, the pivot shaft may be adjusted to advance intake valve timing during high engine loads and then adjusted again to retard intake valve timing during low engine loads. In this way, valve timing may be adjusted to increase engine efficiency and reduce emissions.

Figure 1:
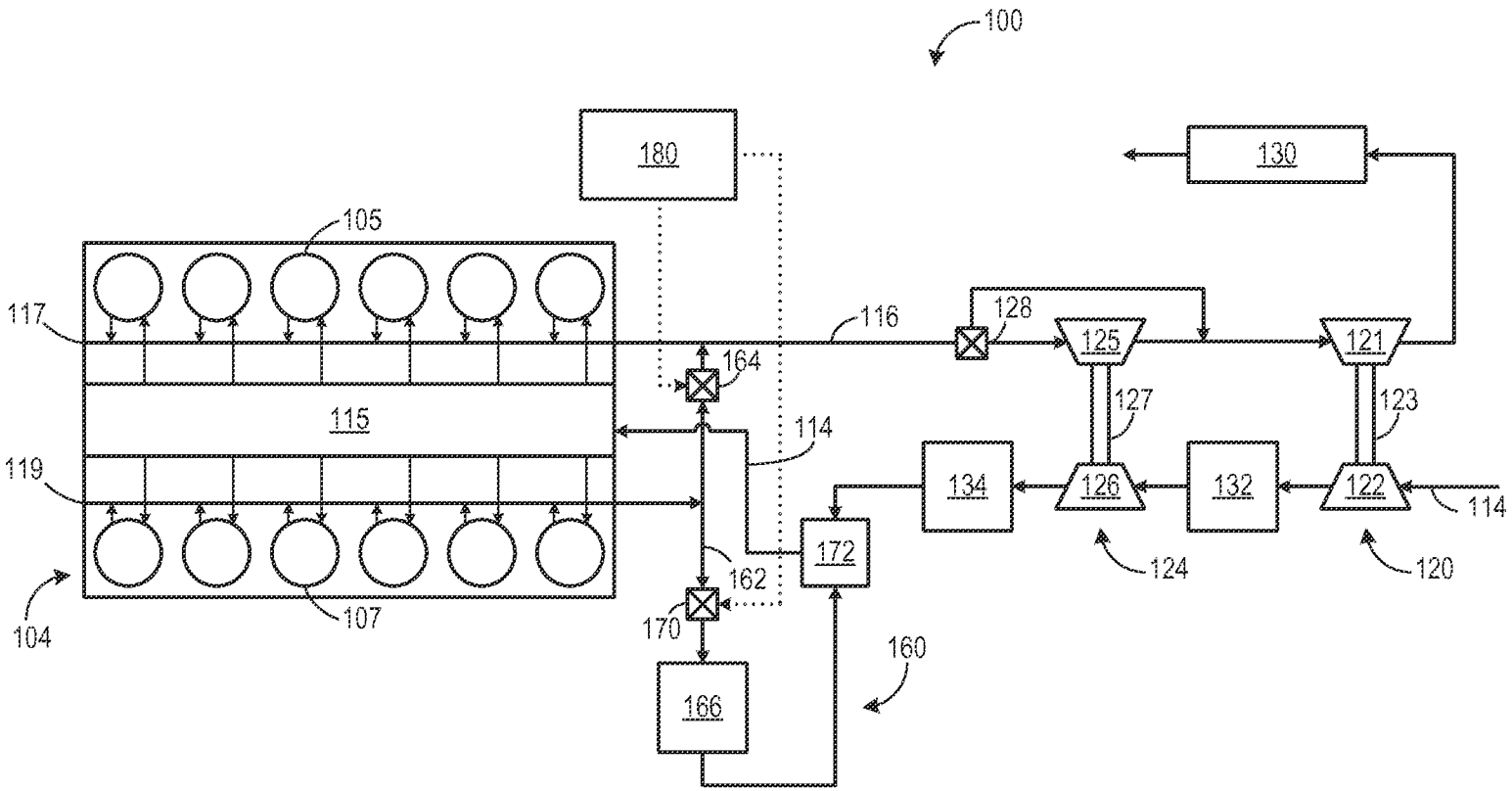
FIG. 1 shows a schematic diagram of an engine system according to an embodiment of the invention

FIG. 1 shows a block diagram of an exemplary embodiment of an engine system 100 with an engine 104, such as an internal combustion engine. The engine 104 receives intake air for combustion from an intake, such as an intake manifold 115. The intake may be any suitable conduit or conduits through which gases flow to enter the engine. For example, the intake may include the intake manifold 115, an intake passage 114, and the like. The intake passage 114 receives ambient air from an air filter (not shown) that filters air from outside of a vehicle in which the engine 104 may be positioned. Exhaust gas resulting from combustion in the engine 104 is supplied to an exhaust, such as exhaust passage 116. The exhaust may be any suitable conduit through which gases flow from the engine. For example, the exhaust may include an exhaust manifold 117, the exhaust passage 116, and the like. Exhaust gas flows through the exhaust passage 116.

Engine 104 is a Vee engine (e.g., V-engine). In the example embodiment depicted in FIG. 1, the engine 104 is a V-12 engine having twelve cylinders. In other examples, the engine may be a V-6, V-8, V-10, or V-16 or any suitable V engine configuration. As depicted, the engine 104 includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. It should be understood, the engine may have any desired numbers of donor cylinders and non-donor cylinders, with the number of donor cylinders typically lower than the number of non-donor cylinders. Alternatively, the engine may have no donor cylinders in the case of an engine without EGR.

As depicted in FIG. 1, the non-donor cylinders 105 are coupled to the exhaust passage 116 to route exhaust gas from the engine to atmosphere (after it passes through an exhaust gas treatment system 130 and first and second turbochargers 120 and 124). The donor cylinders 107, which provide engine exhaust gas recirculation (EGR), are coupled exclusively to an EGR passage 162 of an EGR system 160 which routes exhaust gas from the donor cylinders 107 to the intake passage 114 of the engine 104, and not to atmosphere. By introducing cooled exhaust gas to the engine 104, the amount of available oxygen for combustion is decreased, thereby reducing combustion flame temperatures and reducing the formation of nitrogen oxides (e.g., $NO_x$).

Thus, the engine includes a first, donor cylinder group configured to route exhaust to the intake and/or atmosphere, and a second, non-donor cylinder group configured to route exhaust only to atmosphere. The non-donor cylinder exhaust manifold 117 and donor cylinder exhaust manifold 119 are maintained separately from each other. Other than the crossover passage controlled by a first valve 164, the manifolds do not include common passageways enabling communication between the non-donor cylinder manifold and the donor cylinder manifold. However, both the first, donor cylinder group and second, non-donor cylinder group receive the same intake air via the intake manifold 115, and are subject to equal intake manifold pressure.

In the example embodiment shown in FIG. 1, when a second valve 170 is open, exhaust gas flowing from the donor cylinders 107 to the intake passage 114 passes through a heat exchanger such as an EGR cooler 166 to reduce a temperature of (e.g., cool) the exhaust gas before the exhaust gas returns to the intake passage. The EGR cooler 166 may be an air-to-liquid heat exchanger, for example. In such an example, one or more charge air coolers 132 and 134 disposed in the intake passage 114 (e.g., upstream of where the recirculated exhaust gas enters) may be adjusted to further increase cooling of the charge air such that a mixture temperature of charge air and exhaust gas is maintained at a desired temperature. In other examples, the EGR system 160 may include an EGR cooler bypass. Alternatively, the EGR system may include an EGR cooler control element. The EGR cooler control element may be actuated such that the flow of exhaust gas through the EGR cooler is reduced; however, in such a configuration, exhaust gas that does not flow through the EGR cooler is directed to the exhaust passage 116 rather than the intake passage 114.

Further, the EGR system 160 includes a first valve 164 disposed between the exhaust passage 116 and the EGR passage 162. The second valve 170 may be an on/off valve controlled by the control unit 180 (for turning the flow of EGR on or off), or it may control a variable amount of EGR, for example. In some examples, the first valve 164 may be actuated such that an EGR amount is reduced (exhaust gas flows from the EGR passage 162 to the exhaust passage 116). In other examples, the first valve 164 may be actuated such that the EGR amount is increased (e.g., exhaust gas flows from the exhaust passage 116 to the EGR passage 162). In some embodiments, the EGR system 160 may include a plurality of EGR valves or other flow control elements to control the amount of EGR.

In such a configuration, the first valve 164 is operable to route exhaust from the donor cylinders to the exhaust passage 116 of the engine 104 and the second valve 170 is operable to route exhaust from the donor cylinders to the intake passage 114 of the engine 104. As such, the first valve 164 may be referred to as an exhaust valve, while the second valve 170 may be referred to as an EGR valve. In the example embodiment shown in FIG. 1, the first valve 164 and the second valve 170 may be engine oil, or hydraulically, actuated valves, for example, with a shuttle valve (not shown) to modulate the engine oil. In some examples, the valves may be actuated such that one of the first and second valves 164 and 170 is normally open and the other is normally closed. In other examples, the first and second valves 164 and 170 may be pneumatic valves, electric valves, or another suitable valve.

As shown in FIG. 1, the engine system 100 further includes an EGR mixer 172 which mixes the recirculated exhaust gas with charge air such that the exhaust gas may be evenly distributed within the charge air and exhaust gas mixture. In the example embodiment depicted in FIG. 1, the EGR system 160 is a high-pressure EGR system which routes exhaust gas from a location upstream of turbochargers 120 and 124 in the exhaust passage 116 to a location downstream of turbochargers 120 and 124 in the intake passage 114. In other embodiments, the engine system 100 may additionally or alternatively include a low-pressure EGR system which routes exhaust gas from downstream of the turbochargers 120 and 124 in the exhaust passage 116 to a location upstream of the turbochargers 120 and 124 in the intake passage 114.

As depicted in FIG. 1, the engine system 100 further includes a two-stage turbocharger with the first turbocharger 120 and the second turbocharger 124 arranged in series, each of the turbochargers 120 and 124 arranged between the intake passage 114 and the exhaust passage 116. The two-stage turbocharger increases air charge of ambient air drawn into the intake passage 114 in order to provide greater charge density during combustion to increase power output and/or engine-operating efficiency. The first turbocharger 120 operates at a relatively lower pressure, and includes a first turbine 121 which drives a first compressor 122. The first turbine 121 and the first compressor 122 are mechanically coupled via a first shaft 123. The second turbocharger 124 operates at a relatively higher pressure, and includes a second turbine 125 which drives a second compressor 126. The second turbine and the second compressor are mechanically coupled via a second shaft 127. In the example embodiment shown in FIG. 1, the second turbocharger 124 is provided with a wastegate 128 which allows exhaust gas to bypass the second turbocharger 124. The wastegate 128 may be opened, for example, to divert the exhaust gas flow away from the second turbine 125. In this manner, the rotating speed of the compressors 126, and thus the boost provided by the turbochargers 120, 124 to the engine 104 may be regulated during steady state conditions. In other embodiments, each of the turbochargers 120 and 124 may be provided with a wastegate, or only the second turbocharger 124 may be provided with a wastegate. In another embodiment, engine system 100 may only include one turbocharger, such as second turbocharger 124.

The engine system 100 further includes an exhaust treatment system 130 coupled in the exhaust passage in order to reduce regulated emissions. As depicted in FIG. 1, the exhaust gas treatment system 130 is disposed downstream of the turbine 121 of the first (low pressure) turbocharger 120. In other embodiments, an exhaust gas treatment system may be additionally or alternatively disposed upstream of the first turbocharger 120. The exhaust gas treatment system 130 may include one or more components. For example, the exhaust gas treatment system 130 may include one or more of a diesel particulate filter (DPF), a diesel oxidation catalyst (DOC), a selective catalytic reduction (SCR) catalyst, a three-way catalyst, a $NO_x$ trap, and/or various other emission control devices or combinations thereof.

The engine system 100 further includes the control unit 180, which is provided and configured to control various components related to the engine system 100. In one example, the control unit 180 includes a computer control system. The control unit 180 further includes non-transitory, computer readable storage media including code for enabling on-board monitoring and control of engine operation. The control unit 180, while overseeing control and management of the engine system 100, may be configured to receive signals from a variety of engine sensors, as further elaborated herein, in order to determine operating parameters and operating conditions, and correspondingly adjust various engine actuators to control operation of the engine system 100. For example, the control unit 180 may receive signals from various engine sensors including, but not limited to, engine speed, engine load, boost pressure, ambient pressure, exhaust temperature, exhaust pressure, etc. Correspondingly, the control unit 180 may control the engine system 100 by sending commands to various components such as traction motors, alternator, cylinder valves, throttle, heat exchangers, wastegates or other valves or flow control elements, etc.

Figure 2:
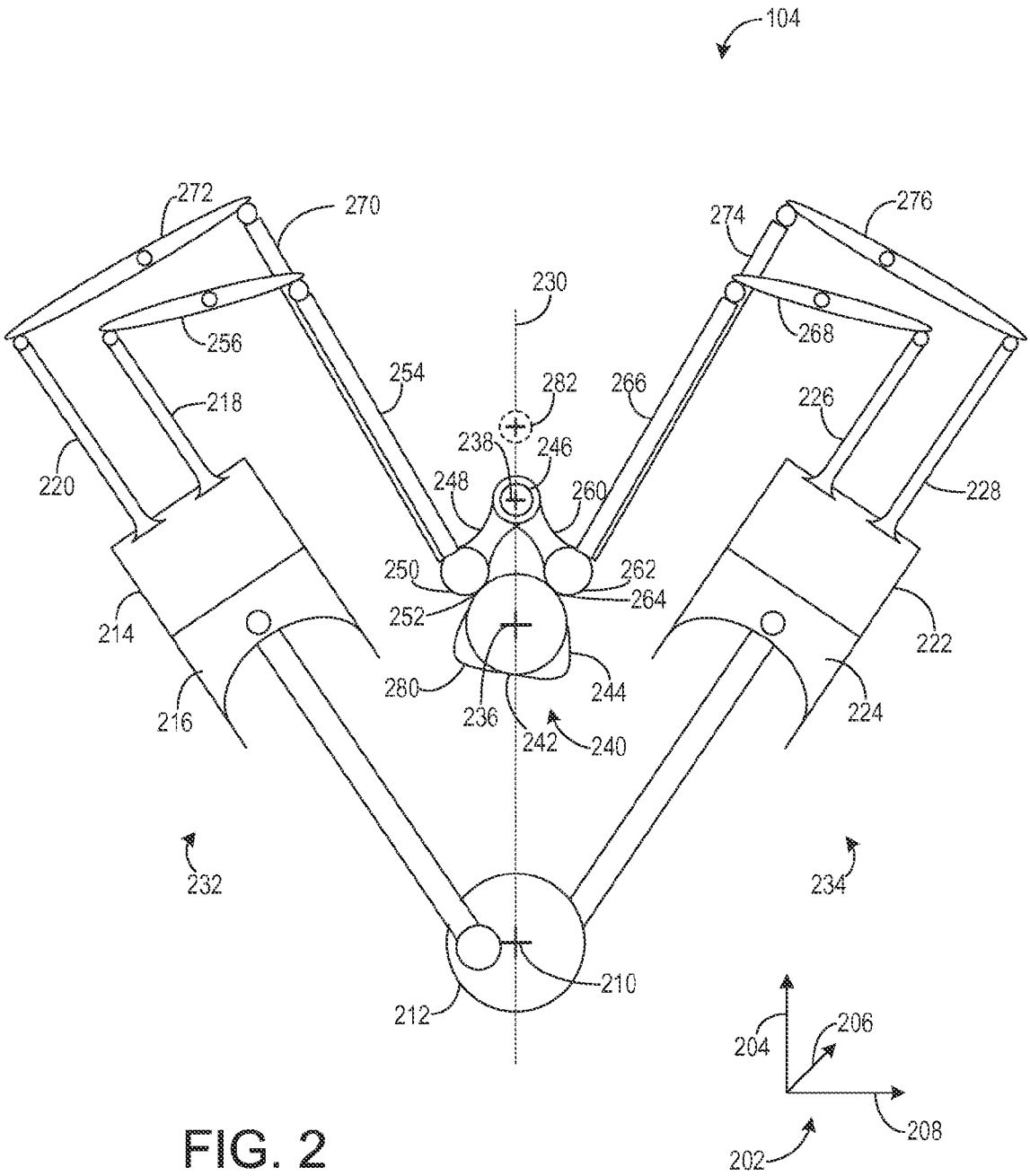
FIG. 2 shows a schematic diagram of a V-engine according to an embodiment of the invention.

FIG. 2 shows a schematic diagram of engine 104 with two cylinders shown. A coordinate axis 202 is shown depicting a vertical axis 204, a lateral axis 206, and a horizontal axis 208. As discussed above, engine 104 is a Vee type engine in which the cylinders and pistons are aligned, in two separate planes or banks, so that they appear to be in a "V" when viewed along the lateral axis 206 (e.g., into the page).

FIG. 2 shows two cylinders of engine 104, a first cylinder 214 with a first piston 216, a first intake valve 218, and a first exhaust valve 220, and a second cylinder 222 with a second piston 224, a second intake valve 226, and a second exhaust valve 228. The first cylinder 214 is part of a first bank of cylinders 232 (e.g., first bank) to the left of a vertical axis 230 of a crankshaft 212. Thus, the first bank 232 may be referred to as the left bank. The second cylinder 222 is part of a second bank of cylinders 234 (e.g., second bank) to the right of the vertical axis 230 of the crankshaft 212. Thus, the second bank 234 may be referred to as the right bank.

The first piston 216 and the second piston 224 are coupled to the crankshaft 212 so that reciprocating motion of the pistons is translated into rotational motion of the crankshaft around an axis of rotation 210. In some embodiments, the engine may be a four-stroke engine in which each of the cylinders fires in a firing order during two revolutions of the crankshaft 212. In other embodiments, the engine may be a two-stroke engine in which each of the cylinders fires in a firing order during one revolution of the crankshaft 212.

The first intake valve 218 controls the intake air entering the first cylinder 214 from the intake manifold 115 (shown in FIG. 1) for combustion. As such, when the first intake valve 218 is actuated, intake air enters the first cylinder 214. Similarly, the second intake valve 226 controls the intake air entering the second cylinder 222. The first exhaust valve 220 controls the flow of exhaust gases from combustion exiting the first cylinder 214 and traveling to an exhaust manifold (such as non-donor cylinder exhaust manifold 117). Similarly, the second exhaust valve 228 controls the flow of exhaust exiting the second cylinder 222.

The timing of the intake and/or exhaust valves is controlled by a cam follower system 240. The cam follower system 240 includes a camshaft 242 driven by the rotation of the crankshaft 212 around the axis of rotation 210. The camshaft 242 is rotatable around an axis of rotation 236 of the camshaft. In embodiments, the camshaft 242 is the single, or only, camshaft for engine 104, and may be centrally located between the left bank 232 and the right bank 234 on the vertical axis 230. The camshaft 242 extends in a lateral direction along the lateral axis 206, along the length of the cylinder banks. A plurality of cam lobes may be disposed along the length of the camshaft 242, such as a first cam lobe 244 and a second cam lobe 280. In the example shown in FIG. 2, the second cam lobe 280 is positioned behind, in the direction of the lateral axis 206, the first cam lobe 280. In some examples, the camshaft 242 may have one cam lobe for every intake and exhaust valve of the engine.

The cam follower system 240 further includes a rotatable pivot shaft 246 offset from the camshaft 242. The pivot shaft 246 extends along the lateral axis 206 along the bank of cylinders. An axis of rotation 238 of the pivot shaft 246 is located vertically above, with respect to the vertical axis 204, the axis of rotation 236 of the camshaft 242, both axes laterally positioned (e.g., axes positioned along the lateral axis 206) in the V-engine.

Figure 3:
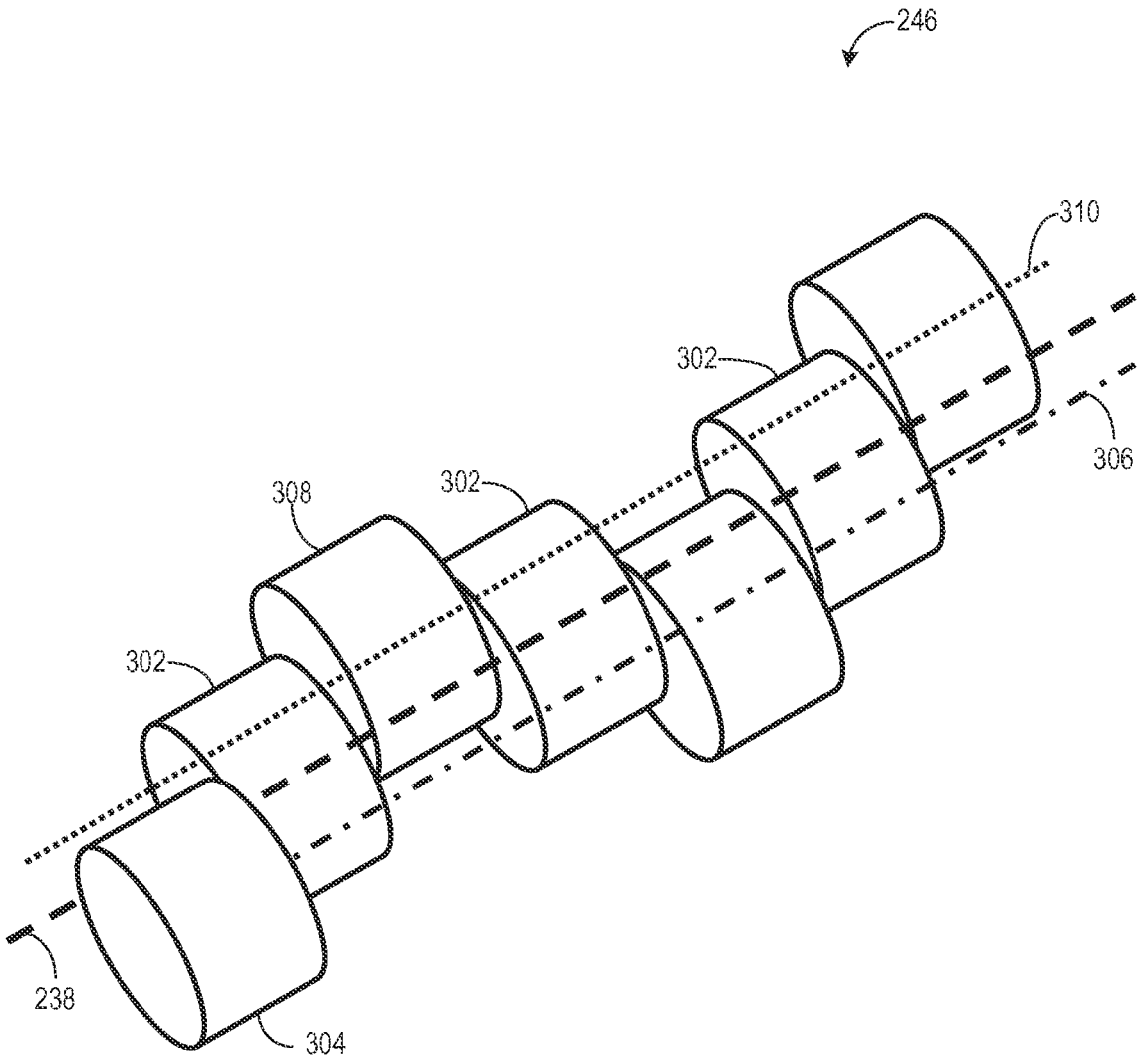
FIG. 3 shows a schematic of a pivot shaft of a V-engine according to an embodiment of the invention.

One embodiment of a pivot shaft 246 is shown in FIG. 3. A main shaft 302 of the pivot shaft 246 may rotate or pivot about the axis of rotation 238 of the pivot shaft 246. The pivot shaft 246 includes a plurality of offset segments or pivot points which are eccentrically positioned with respect to the axis of rotation 238 of the rotatable pivot shaft 246. In the example shown in FIG. 3, the pivot shaft 246 has a first pivot point 304 centered along an axis 306. Two or more of the first pivot points 304 may constitute a first group of eccentric pivot points (referred to herein as pivot points). As such, the first group of eccentric pivot points, and axis 306, are offset from the axis of rotation 238 of the pivot shaft 246. The pivot shaft 246 further comprises a second pivot point 308 centered along an axis 310. Two or more of the second pivot points 308 may constitute a second group of eccentric pivot points. As such, the second group of eccentric pivot points, and axis 310, are offset from the axis of rotation 238 of the pivot shaft 246.

In another embodiment, the pivot shaft 246 may have a third group of eccentric pivot points and a fourth group of eccentric pivot points, each group of pivot points offset from the axis of rotation 238 of the pivot shaft 246. Each group of pivot points may control the valve timing of a different set of valves. For example, a position of the first group of pivot points may control the timing of a group of intake valves on the left bank while a position of the second group of pivot points may control the timing of a group of intake valves on the right bank. Further, a position of the third group of pivot points may control the timing of a group of exhaust valves on the left bank and a position of the fourth group of pivot points may control the timing of a group of exhaust valves on the right bank. It should be understood that the pivot shaft 246 may have a number of combinations of eccentric pivot points offset in different directions and by different amounts from the axis of rotation 238 of the pivot shaft 246. In this way, the timing of the intake and exhaust valves may be adjusted based on engine operating requirements.

Engine 104 may comprise a plurality of cam followers; each cam follower drives a pushrod coupled through a rocker to either an intake or exhaust valve. As such, movement of each cam follower may drive the actuation of the cam follower's respective valve. Each cam follower of engine 104 may be coupled to one segment or pivot point on the pivot shaft 246. For example, the cam follower may be coupled to a segment of the main shaft 302, or an offset segment of the pivot shaft 246 such as first pivot point 304 or second pivot point 308. One end of the cam follower may be coupled around a pivot point or shaft segment such that the cam follower is rotatable around the pivot point. In one example, the cam follower may comprise a ring at a first end of the cam follower, the ring encircling the pivot point. An outer circumference of the pivot point and an inner circumference of the ring of the cam follower may be separated by an amount of space in order to allow free rotation of the ring of the cam follower around the pivot point.

Specifically, as shown in FIG. 2, the first pivot point 304 on the pivot shaft 246 is coupled to a first end of a first cam follower 248. The first cam follower 248 is coupled at a second end of the first cam follower 248 to a first roller 250. The first roller 250 contacts the camshaft 242 at a first contact point 252. The first roller 250 is further coupled to a first end of a first pushrod 254. The first pushrod 254 is coupled at a second end to a first rocker 256. The first rocker 256 is further coupled to the first intake valve 218.

The second pivot point 308 on the pivot shaft 246 is coupled to a first end of a second cam follower 260. The second cam follower 260 is coupled at a second end of the second cam follower 260 to a second roller 262. The second roller 262 contacts the camshaft 242 at a second contact point 264. The second roller 262 is further coupled to a first end of a second pushrod 266. The second pushrod 266 is coupled at a second end to a second rocker 268. The second rocker 268 is further coupled to the second intake valve 226.

As discussed above, in one embodiment, the pivot shaft 246 may have a third group of eccentric pivot points and a fourth group of eccentric pivot points. In this example, the third pivot points (not shown) may be coupled to a third cam follower (not shown), wherein the third cam follower is coupled at a second end of the third cam follower to a third roller (not shown). Referring to FIG. 2, the third cam follower and third roller may be located behind, in the lateral direction, the first cam follower 248 and the first roller 250. The third roller may be coupled to a first end of a third pushrod 270. The third pushrod 270 is coupled at a second end to a third rocker 272. The third rocker 272 is further coupled to the first exhaust valve 220. In this way, the third group of eccentric pivot points may drive a first group of exhaust valves of the first cylinder group on the left bank.

Further, a fourth pivot point (not shown) may be coupled to a fourth cam follower (not shown), wherein the fourth cam follower is coupled at a second end of the fourth cam follower to a fourth roller (not shown). Referring to FIG. 2, the fourth cam follower and fourth roller may be located behind, in the lateral direction, the second cam follower 260 and the second roller 262. The fourth roller may be coupled to a first end of a fourth pushrod 274. The fourth pushrod 274 is coupled at a second end to a fourth rocker 276. The fourth rocker 276 is further coupled to the second exhaust valve 228. In this way, the fourth group of eccentric pivot points may drive a second group of exhaust valves of the second cylinder group on the right bank.

FIG. 2 shows one cylinder on each bank. However, as discussed above, engine 104 may have a plurality of cylinders on each bank, each with like components to those shown in FIG. 2. Each valve of each cylinder may be driven by a pushrod and a cam follower. Further, each cam follower may be rotatable about a pivot point on the pivot shaft. As such, the system of FIG. 2 may provide for an engine system including a V-engine with a single, central camshaft; a rotatable pivot shaft offset from the camshaft; a first group of cam followers driven by the camshaft and pivoted about the rotatable pivot shaft; a first group of pushrods driving valves of a first cylinder group, the first group of pushrods operatively coupled with the first group of cam followers; a second group of cam followers driven by the camshaft and pivoted about the rotatable pivot shaft; and a second group of pushrods driving valves of a second cylinder group, the second group of pushrods operatively coupled with the second group of cam followers.

In this system, the first group of pushrods may drive a first group of intake valves and a first group of exhaust valves of the first cylinder group and the second group of pushrods may drive a second group of intake valves and a second group of exhaust valves of the second cylinder group. Further, the cam followers may pivot about pivot points on the rotatable pivot shaft, the pivot points eccentrically positioned with respect to the axis of rotation of the rotatable pivot shaft.

In one example, the pivot shaft may have a first group of eccentric pivot points offset from the axis of rotation of the pivot shaft and a second group of eccentric pivot points offset from the axis of rotation of the pivot shaft, the first group of cam followers being rotatable about the first group of eccentric pivot points, and the second group of cam followers being rotatable about the second group of eccentric pivot points. The first group of eccentric pivot points may be coupled through the first group of pushrods to a first group of intake valves of the first cylinder group and the second group of eccentric pivot points may be coupled through the second group of pushrods to a second group of intake valve of the second cylinder group.

In some examples, the pivot shaft may have a third group of eccentric pivot points driving a first group of exhaust valves of the first cylinder group and a fourth group of eccentric pivot points driving a second group of exhaust valves of the second cylinder group.

In an alternate embodiment of engine 104, an optional second pivot shaft may be included. As shown in FIG. 2, a second rotatable pivot shaft 282 is optionally positioned vertically above the axis of rotation of the pivot shaft 246 (e.g., the first pivot shaft), the second rotatable pivot shaft having a lateral axis of rotation. The second rotatable pivot shaft 282 may have a first group of eccentric pivot points offset from the axis of rotation of the second pivot shaft and a second group of eccentric pivot point offset from the axis of rotation of the second pivot shaft. The system may further comprise a third group of cam followers (not shown) being rotatable about the first group of eccentric pivot points of the second rotatable pivot shaft, the third group of cam followers driving a first group of exhaust valves of the first cylinder group, and a fourth group of cam followers (not shown) being rotatable about the second group of eccentric pivot points of the second rotatable pivot shaft, the fourth group of cam followers driving a second group of exhaust valves of the second cylinder group. In this way, rotating the second pivot shaft 282 may adjust the valve timing of a group of exhaust valves while rotating the pivot shaft 246 (e.g., first pivot shaft) may adjust the valve timing of a group of intake valves.

Figure 7:
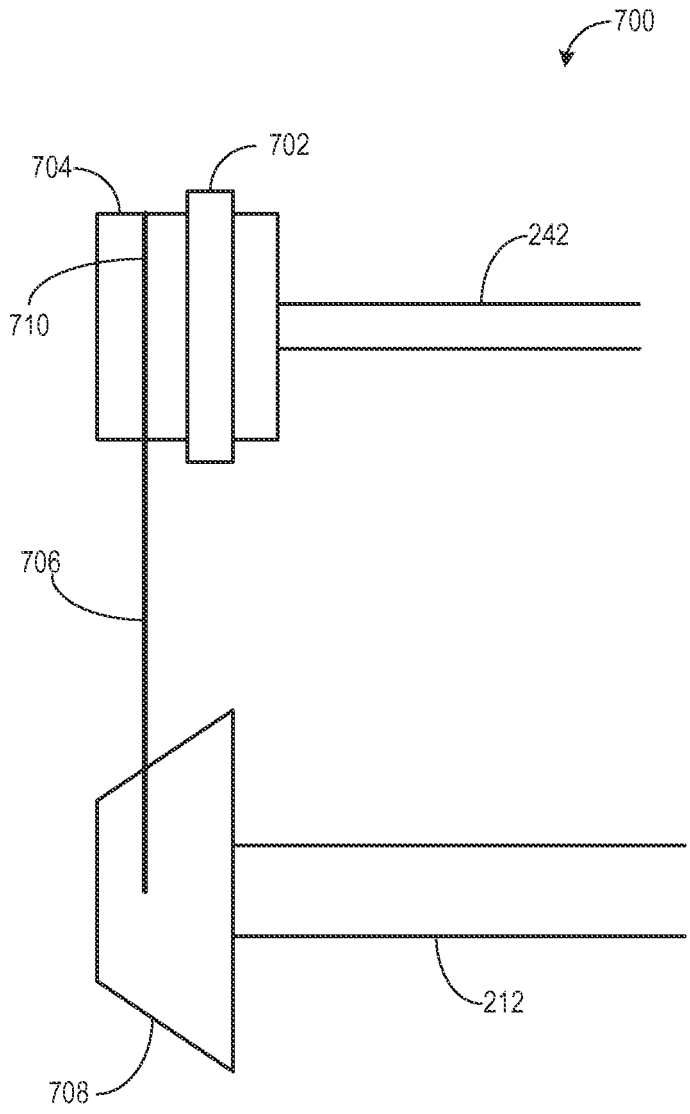
FIG. 7 shows a schematic diagram of a cam phaser system according to an embodiment of the invention.

FIG. 7 shows a schematic 700 of another embodiment in which the engine system may further comprise a cam phaser type vane actuator coupled to the camshaft 242 for varying a cam timing relative to crank timing. As shown in FIG. 7, a crankshaft 212 is coupled to a drive sprocket 708. A first end of a chain drive 706 is coupled to the drive sprocket 708 and a second end of the chain drive 706 is coupled to an input sprocket 710. The input sprocket 710 is hydraulically coupled to the camshaft 242 through a hydraulic vane actuator 702. The input sprocket 710 and the hydraulic vane actuator 702 are housed within an output housing 704. The input sprocket 710 drives the camshaft 242 and the hydraulic vane actuator 702 may adjust a phase of rotation of the camshaft 242 to vary valve timing. In one example, the cam phaser shown in FIG. 7 may be combined with the pivot shaft shown in FIG. 2 in order to independently control intake and exhaust valve timing. In this embodiment, the entire camshaft 242 may by shifted by an angular offset from the crankshaft 212. This action affects the timing of both the intake and exhaust valves in the same direction. If the camshaft 242 is retarded with respect to the crankshaft 212, both the opening and closing points of both the intake and exhaust valves are retarded by the same angle. Similarly, if the camshaft 242 is advanced with respect to the crankshaft 212, both the opening and closing points of both the intake and exhaust valves are advanced by the same angle. If the eccentric action of the pivot shaft is attached to the intake valve or the exhaust valve, the rotation of the pivot shaft can shift the intake or exhaust valve relative to the angular offset of the cam phaser.

Figure 8:
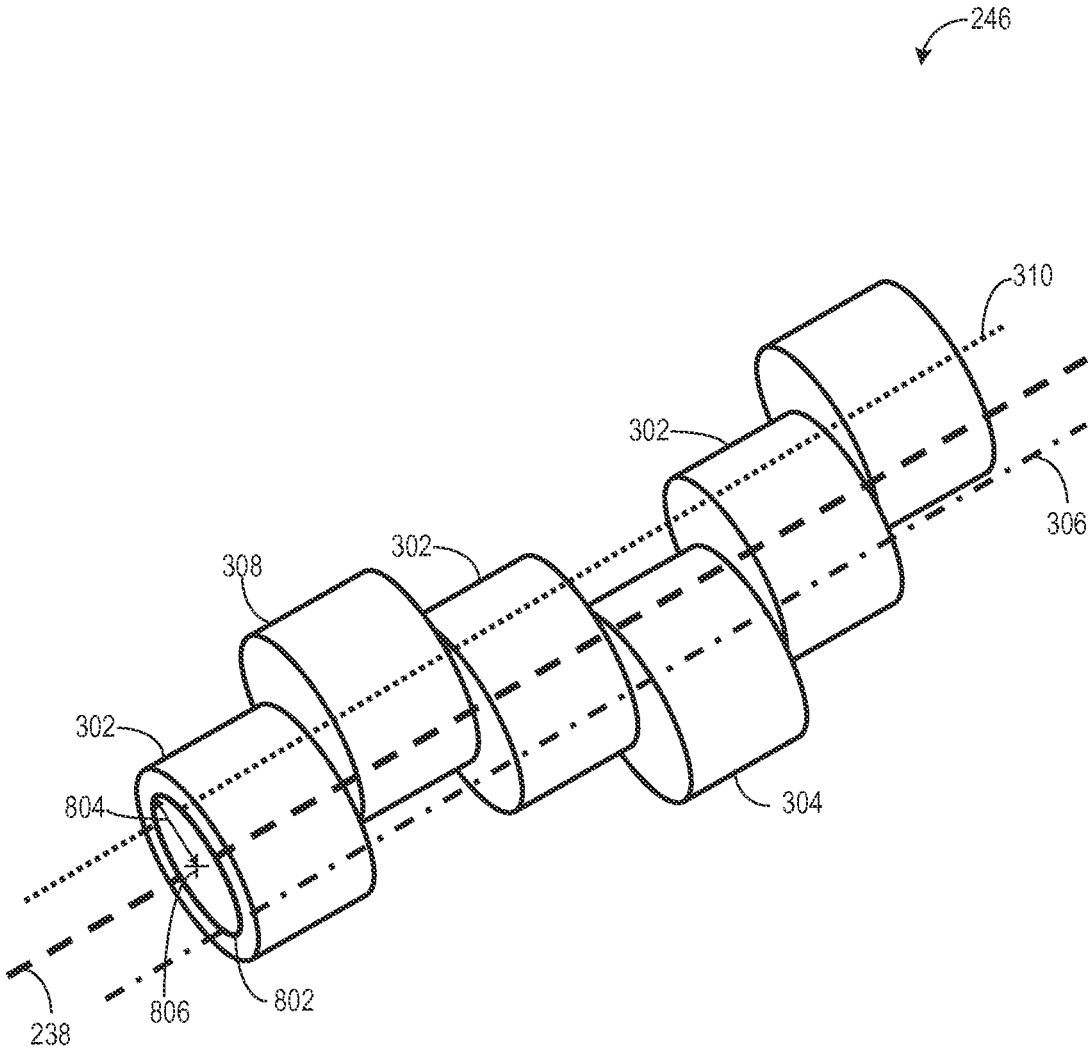
FIG. 8 shows a schematic diagram of a pivot shaft with an eccentric bushing element according to an embodiment of the invention.

FIG. 8 shows yet another embodiment in which the rotatable pivot shaft 246 may include a first and a second separately rotatable element. For example, the pivot shaft may be mounted in an eccentric bushing 802 element. This may allow independent control of the intake and exhaust events by rotating the pivot shaft and bushing in the same direction or in an opposite direction. The eccentric bushing 802 adds a further degree of offset by offsetting the axis of rotation 238 of the main shaft 302 from a center 806 of the eccentric bushing 802. The offset may be defined by a radius 804 of the eccentric bushing 802. This additional offset may advance or retard all the pivot points in the same direction, both the intake and exhausts and both the left and right banks. In this way, the eccentric bushing element operates similar to the cam phaser. Rotation of the pivot shaft 246 on axis of rotation 238 would have the same effect on the timing of the valves attached to the eccentric pivot points. The valve timing could be further advanced or retarded with respect to the phase change on the entire pivot shaft made by the eccentric bushing.

In some embodiments of engine system 100, a control unit 180 (e.g., controller) may be configured to vary a valve timing of the first cylinder and the second cylinder by rotating the pivot shaft. Rotating the pivot shaft may include translating the first pivot point and the second pivot point, thereby shifting the first cam follower and the second cam follower and their respective contact points on the camshaft. As such, the direction and/or degree of rotation of the pivot shaft may determine whether valve timing is advanced, retarded, or neutral. Further details on adjusting the pivot shaft to adjust valve timing are presented below with reference to FIGS. 4-5.

As introduced above, intake and exhaust valves control intake air entering engine cylinders for combustion and exhaust gas exiting the engine cylinders after combustion, respectively. The timing of opening and closing these valves may affect the amount of air available for combustion and the power output and $NO_x$ production of the engine. As such, intake and exhaust valve events may be optimized to reduce emissions and improve fuel consumption. For example, by closing the intake valve at or before bottom dead center of the piston stroke, the air capture in the cylinder and the effective compression ratio may be reduced, thereby reducing $NO_x$ production and increasing engine efficiency at high engine power levels. Bottom dead center may be defined as the point in a piston stroke when the piston is at the bottom of the cylinder and closest to the crankshaft. However, if valve timing is optimized in this way at high engine loads, the acceleration performance of the engine at low engine loads may suffer. For example, when the intake valve timing is advanced such that the valve closes at or before bottom dead center during low engine loads, the engine may not get enough intake air. Boost produced by the turbocharger of the engine may compensate for decreased air capture. However, this may result in decreased turbocharger air flow and low air fuel ratio, thereby reducing acceleration at low engine loads. Thus, during low engine load conditions, retarding intake valve timing may increase engine performance. By adjusting the timing (e.g., opening and closing) of intake and/or exhaust valves based on engine operating conditions such as engine load, engine efficiency may be increased.

In one example, the pivot shaft described above with reference to FIGS. 2-3 may be adjusted to adjust the timing of intake and/or exhaust valves during different engine operating conditions. A valve timing may be determined based on the position (e.g., offset) of the pivot point relative to the axis of rotation of the pivot shaft and the resulting positions of the pivot point as the pivot shaft rotates around the axis of rotation of the pivot shaft. For example, as the pivot shaft rotates in one direction, the position of the pivot point shifts with respect to a vertical and horizontal axis through the center of the pivot shaft. As the pivot point shifts, the corresponding cam follower moves and the location at which the cam follower contacts the camshaft shifts with respect to a vertical axis of the camshaft. Therefore, the position of the pivot point may determine whether valve timing is neutral (standard timing), advanced, or retarded. As described above, the position of the pivot points and the timing of the valves may be chosen based on engine load (e.g., high or low load). Further details on the position of the pivot points and the corresponding changes to valve timing are presented below with reference to FIG. 4-5.

Figure 4:
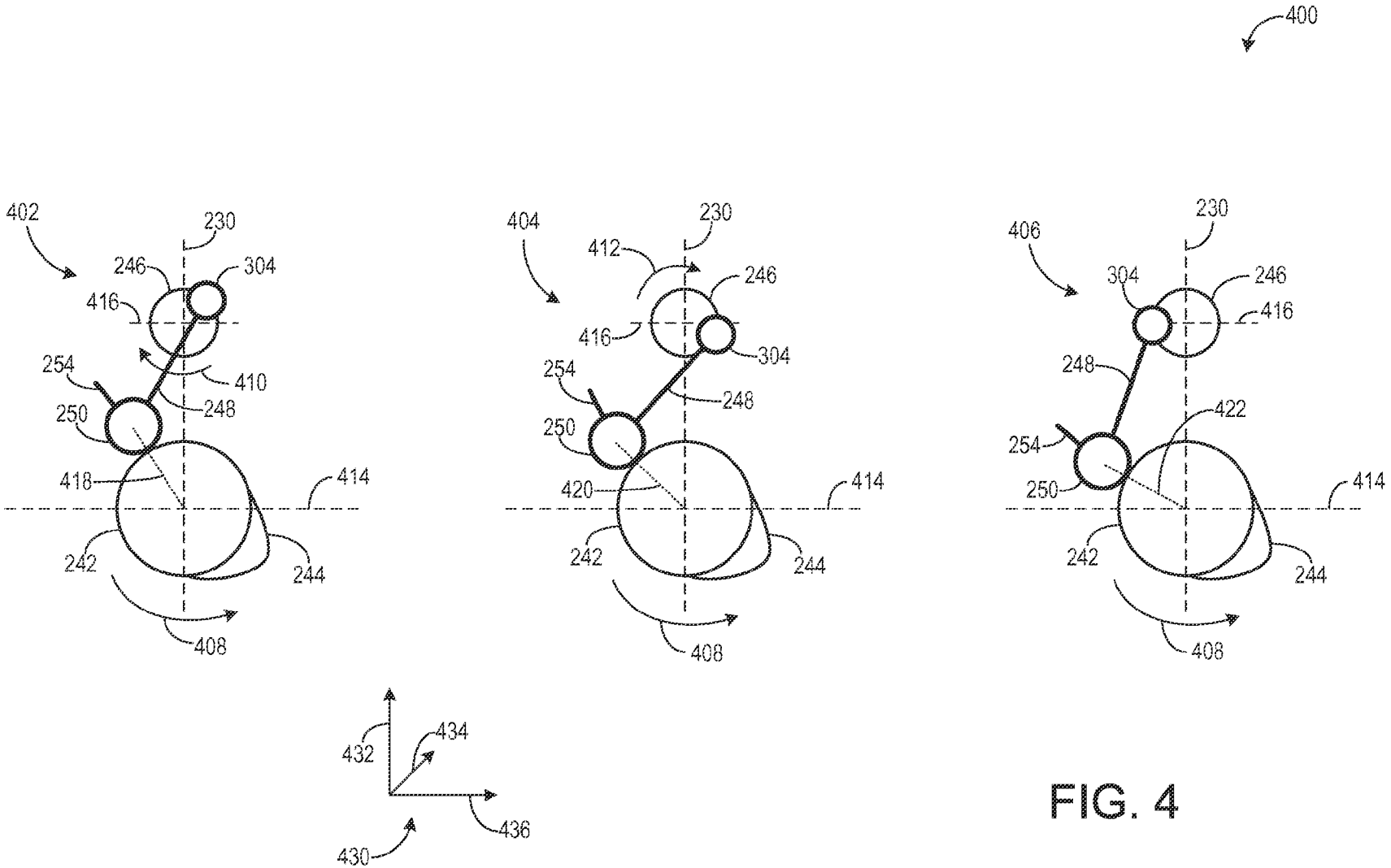
FIG. 4 shows a schematic of positions of a cam follower for a left bank of cylinders of a V-engine according to an embodiment of the invention.
Figure 5:
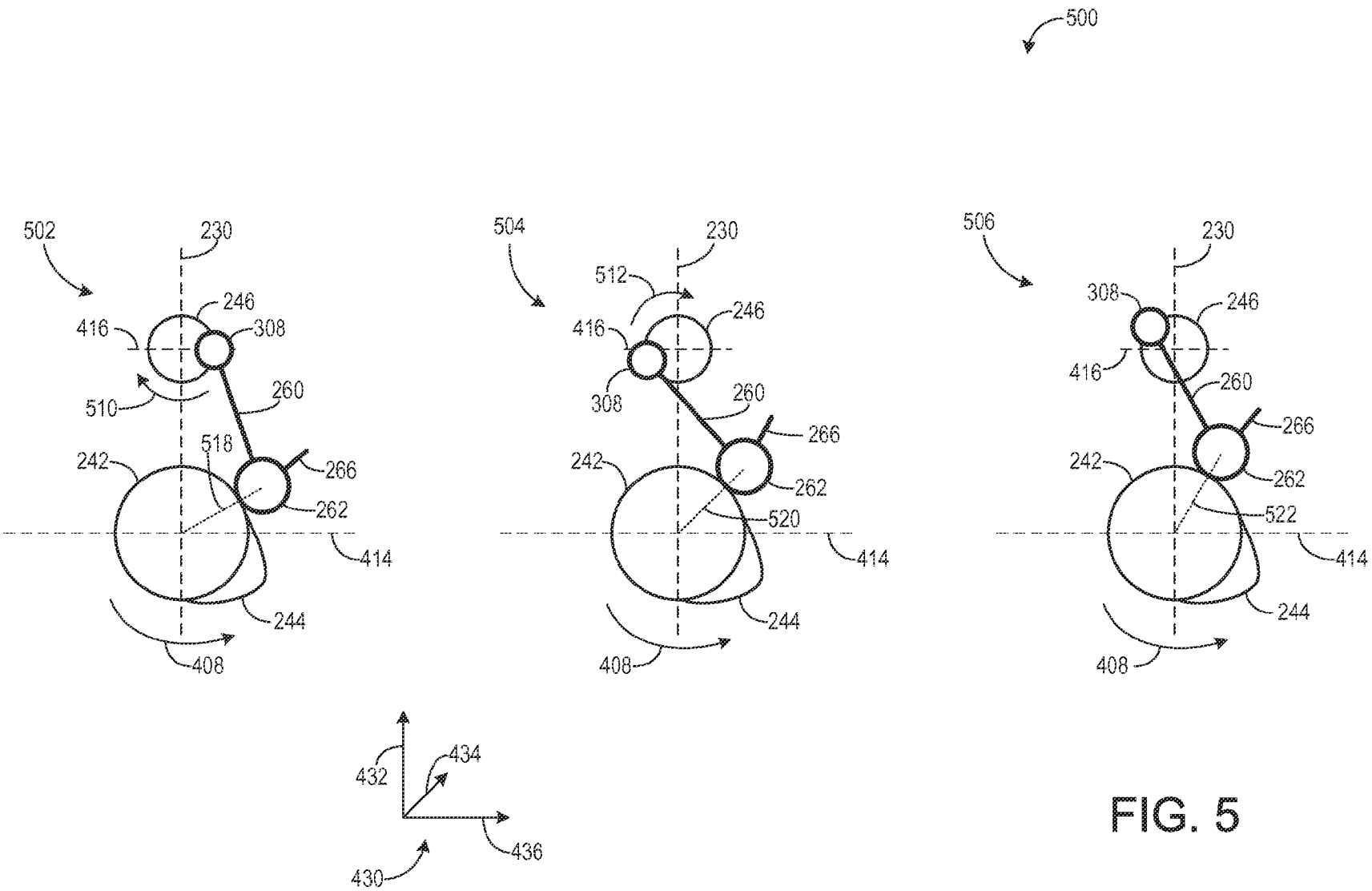
FIG. 5 shows a schematic of positions of a cam follower for a right bank of cylinders of a V-engine according to an embodiment of the invention.

FIGS. 4-5 show movement of a first and second cam follower of a first and second bank of cylinders based on the position of a first and second pivot point on a pivot shaft. FIG. 4 shows a schematic 400 of a portion of a cam follower system for a first or left bank of cylinders, as described above with reference to FIGS. 2-3. An axis system 430 displays a vertical direction 432, a lateral direction 434, and a horizontal direction 436. Schematic 400 shows three positions of a cam follower or a first cam follower 248 relative to a first pivot point 304 on a pivot shaft 246 and a vertical axis 230 (e.g., centerline) of a camshaft 242. The first pivot point 304 moves relative to the vertical axis 230 and a horizontal axis 416 of the pivot shaft as the pivot shaft 246 rotates.

As shown in FIG. 4, a first end of the first cam follower 248 is coupled to the first pivot point 304 of the pivot shaft 246 such that the first cam follower 248 may pivot or freely rotate around the first pivot point 304. A second end of the first cam follower 248 is coupled to the first roller 250. The first roller 250 contacts an outer surface of the camshaft 242. The position of the first roller 250 on the camshaft 242 may change relative to the vertical axis 230 and a horizontal axis 414 of the camshaft 242 based on the position of the first pivot point 304.

The pivot shaft 246 may rotate the first pivot point 304 into a first position 402 to advance valve timing. In the first position 402, the pivot point 304 is to the right of the vertical axis 230 and above the horizontal axis 416. A line of contact 418 shows that the first roller 250 contacts the camshaft 242 at a point which is closer to the vertical axis 230 than the horizontal axis 414 of the camshaft 242. As such, as the camshaft 242 rotates in the direction shown by arrow 408, a first cam lobe 244 will contact and move the first roller 250 sooner in the camshaft rotation than a neutral or standard position (shown at position 404, discussed below). This may cause a first pushrod 254, attached to the first roller 250, to actuate a first valve (intake or exhaust) earlier than the standard set timing, thereby advancing valve timing.

In one example, the pivot shaft 246 may rotate in one direction, in the direction shown by arrow 410. In another example, the pivot shaft 246 may rotate in the direction shown by arrow 410 and a direction opposite the direction shown by arrow 410. As shown in FIG. 4, the pivot shaft 246 may rotate in the direction shown by the arrow 410 to move the first pivot point 304 from the first position 402 (e.g., advanced position) to a second position 404 (e.g., neutral position).

In the second position 404, the first pivot point 304 is below the horizontal axis 416 and to the right of the vertical axis 230. This shifts the first cam follower 248, thereby moving the first roller 250 downward and closer to the horizontal axis 414 of the camshaft 242. As shown by a line of contact 420, the first roller 250 contacts the camshaft 242 at a point between the vertical axis 230 and the horizontal axis 414. As the camshaft 242 rotates in the direction shown by arrow 408, the first cam lobe 244 may contact the first roller 250 later in the camshaft rotation than in the first position 402. As a result, valve timing may be neutral (e.g., neither advanced nor retarded) when the first pivot point 304 is in the second position 404.

The pivot shaft 246 rotates in the direction shown by arrow 412 to translate the first pivot point 304 from the second position 404 (e.g., neutral position) to a third position 406 (e.g., retarded position). In the third position 406, the first pivot point 304 is to the left of the vertical axis 230 and in-line with the horizontal axis 416. This position shifts the first cam follower 248, thereby moving the first roller 250 downward and closer to the horizontal axis 414 of the camshaft 242. As shown by a line of contact 422, the first roller 250 contacts the camshaft 242 at a point closer to the horizontal axis 414 than the vertical axis 230. As the camshaft 242 rotates in the direction shown by arrow 408, the first cam lobe 244 may contact the first roller 250 later in the camshaft rotation than in the first position 402 and the second position 404. This may cause the first pushrod 254, attached to the first roller 250, to actuate the first valve (intake or exhaust) later than the standard set timing, thereby retarding valve timing.

As shown in FIG. 4, as the line of contact between the first roller 250 of a first (e.g., left) bank of cylinders and the camshaft 242 moves closer to the vertical axis 230, valve timing is advanced. Alternatively, as the line of contact between the first roller 250 of the left bank of cylinders and the camshaft 242 moves further away from the vertical axis 230, valve timing is retarded.

In FIG. 4, when the first roller 250 is moved from the first position 402 to the second position 404, the first roller 250 is moved across a peak of a base circle of the camshaft 242. At the second position 404 there is a shorter distance between the first roller 250 and the top of the first pushrod 254. This reduced distance causes a reduction in the operating clearance of the valve train. If the operating clearance is reduced to zero, the valve train forces will increase and cause the valve train to bind. This situation is counter-acted by careful selection of the angular position of the pivot points. If the movement from the first position 402 to the second position 404 is in such a way that the first cam follower 248 is rotated out of the direction of motion of the first pushrod 254, then the rotation increases the clearance while the translation of the first roller 250 across the peak of the base circle reduces the clearance. These two effects counteract each other and the reduction in the clearance in the valve train is minimized. In the movement from the second position 404 to the third position 406, the position of the first roller 250 with respect to the base circle and the rotation of the first cam follower 248 is reversed back to near its original orientation thus restoring the operating clearance of the valve train mechanism. The same effect occurs in FIG. 5, described below, for the other bank of the V-engine.

Now turning to FIG. 5, a schematic 500 of a portion of a cam follower system for a second or right bank of cylinders is shown, as described above with reference to FIGS. 2-3. An axis system 430 displays a vertical direction 432, a lateral direction 434, and a horizontal direction 436. Schematic 500 shows three positions of a cam follower or a second cam follower 260 relative to a second pivot point 308 on the pivot shaft 246 and the vertical axis 230 of the camshaft 242. The second pivot point 308 moves relative to the vertical axis 230 and the horizontal axis 416 of the pivot shaft 246 as the pivot shaft 246 rotates.

As shown in FIG. 5, a first end of the second cam follower 260 is coupled to the second pivot point 308 of the pivot shaft 246 such that the second cam follower 260 may pivot or freely rotate around the second pivot point 308. A second end of the second cam follower 260 is coupled to the second roller 262. The second roller 262 contacts an outer surface of the camshaft 242. The position of the second roller 262 on the camshaft 242 may change relative to the vertical axis 230 and a horizontal axis 414 of the camshaft 242 based on the position of the second pivot point 308.

The pivot shaft 246 may rotate the second pivot point 308 into a first position 502 to advance valve timing. In the first position 502, the pivot point 308 is to the right of the vertical axis 230 and in-line with the horizontal axis 416. A line of contact 518 shows that the second roller 262 contacts the camshaft 242 at a point which is closer to the horizontal axis 414 than the vertical axis 230 of the camshaft 242. As such, as the camshaft 242 rotates in the direction shown by arrow 408, a first cam lobe 244 will contact and move the second roller 262 sooner in the camshaft rotation than a neutral or standard position (shown at second position 504, discussed below). This may cause a second pushrod 266, attached to the second roller 262, to actuate a second valve (intake or exhaust) earlier than the standard set timing, thereby advancing valve timing.

In one example, the pivot shaft 246 may rotate in one direction, in the direction shown by arrow 510. In another example, the pivot shaft 246 may rotate in the direction shown by arrow 510 and a direction opposite the direction shown by arrow 510. As shown in FIG. 5, the pivot shaft 246 may rotate in the direction shown by the arrow 510 to move the second pivot point 308 from the first position 502 (e.g., advanced position) to a second position 504 (e.g., neutral position).

In the second position 504, the second pivot point 308 is below the horizontal axis 416 and to the left of the vertical axis 230. This shifts the second cam follower 260, thereby moving the second roller 262 upward and closer to the vertical axis 230 of the camshaft 242. As shown by a line of contact 520, the second roller 262 contacts the camshaft 242 at a point between the vertical axis 230 and the horizontal axis 414. As the camshaft 242 rotates in the direction shown by arrow 408, the first cam lobe 244 may contact the second roller 262 later in the camshaft rotation than in the first position 502. As a result, valve timing may be neutral (e.g., neither advanced nor retarded) when the second pivot point 308 is in the second position 504.

The pivot shaft 246 rotates in the direction shown by arrow 512 to translate the second pivot point 308 from the second position 504 (e.g., neutral position) to a third position 506 (e.g., retarded position). In the third position 506, the second pivot point 308 is to the left of the vertical axis 230 and above the horizontal axis 416. This shifts the second cam follower 260, thereby moving the second roller 262 upward and closer to the vertical axis 230 of the camshaft 242. As shown by a line of contact 522, the second roller 262 contacts the camshaft 242 at a point closer to the vertical axis 230 than the horizontal axis 414. As the camshaft 242 rotates in the direction shown by arrow 408, the first cam lobe 244 may contact the second roller 262 later in the camshaft rotation than in the first position 502 and the second position 504. This may cause the second pushrod 266, attached to the second roller 262, to actuate the second valve (intake or exhaust) later than the standard set timing, thereby retarding valve timing.

As shown in FIG. 5, as the line of contact between the second roller 262 of a second (e.g., right) bank of cylinders and the camshaft 242 moves closer to the horizontal axis 414 and further away from the vertical axis 230, valve timing is advanced. Alternatively, as the line of contact between the second roller 262 of the right bank of cylinders and the camshaft 242 moves further away from the horizontal axis 414 and closer to the vertical axis 230, valve timing is retarded.

Figure 6:
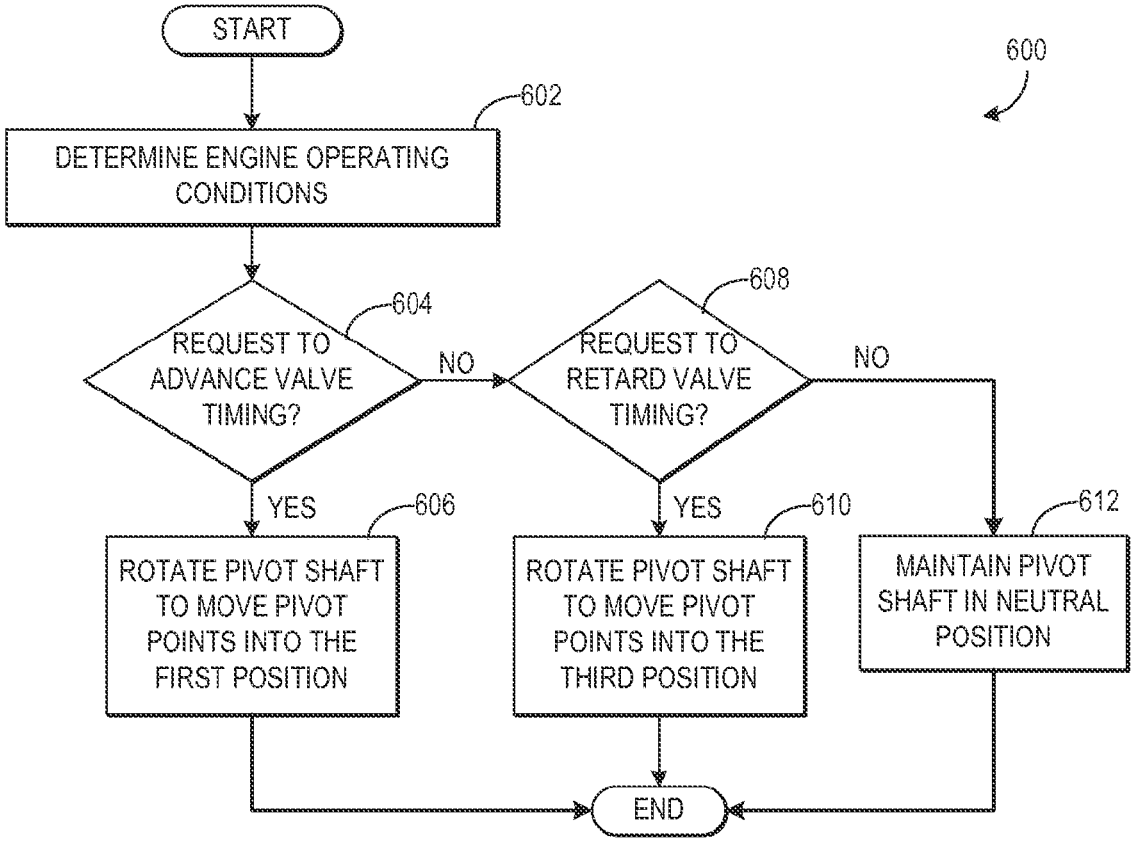
FIG. 6 shows a method for adjusting a pivot shaft to vary a valve timing according to an embodiment of the invention.

FIG. 6 illustrates a method 600 for adjusting the pivot shaft to vary valve timing based on engine operating conditions. Instructions for carrying out the method 600 may be stored in a controller, such as control unit 180 shown in FIG. 1. The method begins at 602 by determining engine operating conditions. Engine operating conditions may include engine speed, engine load, a position of the pivot shaft, current valve timing, a torque request, or the like.

At 604, the method determines whether there is a request to advance valve timing. A request to advance valve timing may include a request to advance intake valve timing, exhaust valve timing, or both. The request to advance valve timing may be based on engine operating conditions. For example, in response to an engine load above an upper threshold level, a request to advance valve timing of the intake valves may be generated. If there is a request to advance valve timing, the control unit may rotate the pivot shaft in a direction which moves the pivot points into the first position at 606, as described above with regard to FIGS. 4-5.

However, if there is not a request to advance valve timing, the method continues on to 608 to determine if there is a request to retard valve timing. A request to retard valve timing may include a request to retard intake valve timing, exhaust valve timing, or both. The request to retard valve timing may be based on engine operating conditions. For example, in response to an engine load below a lower threshold level, a request to retard valve timing of the exhaust valves may be generated. If there is a request to retard valve timing, the control unit may rotate the pivot shaft in a direction which moves the pivot points into the third position at 610, as described above with regard to FIGS. 4-5.

However, if there is not a request to retard valve timing, the method continues on to 612 to maintain the pivot shaft in a neutral position. Alternatively at 612, if the pivot shaft is not currently in a neutral position, the control unit may rotate the pivot shaft into the second position, as described above with regard to FIGS. 4-5.

In this way, a method for varying valve timing of an engine may include rotating a pivot shaft of a cam follower system. With reference to FIGS. 2-5 discussed above, rotating the pivot shaft may result in pivoting a first cam follower for a first cylinder of a first bank and a second cam follower for a second cylinder of a second bank about the rotatable pivot shaft. A camshaft may drive the first cam follower and the second cam follower to operate a respective first valve of the first cylinder and a second valve of the second cylinder. As such, rotating the pivot shaft may vary the valve timing of the first cylinder and the second cylinder. In one example, rotating the pivot shaft may include rotating the pivot shaft in a first direction to advance the valve timing of the first and second cylinder and rotating the pivot shaft in a second, opposite direction, to retard the valve timing of the first and second cylinder. As described above, rotating the pivot shaft includes rotating the pivot shaft about a first lateral axis, the first lateral axis positioned vertically above a second lateral axis of rotation of the camshaft, the first lateral axis and the second lateral axis positioned along a vertical centerline separating the first bank and the second bank, the first bank and the second bank forming a V-engine.

Pivoting the first and second cam follower may include translating a first pivot point and a second pivot point on the pivot shaft away from the centerline, the first pivot point coupled to a first end of the first cam follower and the second pivot point coupled to a first end of the second cam follower. Further, translating the first pivot point includes moving a first contact point between a first roller coupled to a second end of the first cam follower and the camshaft, relative to a cam lobe on the camshaft. Similarly, translating the second pivot point includes moving a second contact point between a second roller coupled to a second end of the second cam follower and the camshaft, relative to the cam lobe on the camshaft.

In one example, the first contact point of the first cam follower may be moved towards the vertical centerline on the camshaft to advance the valve timing of the first valve and the second contact point of the second cam follower may be moved away from the vertical centerline to advance the valve timing of the second valve. In another example, the first contact point of the first cam follower may be moved away from the vertical centerline on the camshaft to retard the valve timing of the first valve and the second contact point of the second cam follower may be moved further from the vertical centerline to retard the valve timing of the second valve.

A shown above, rotating the pivot shaft causes the cam follower to shift and changes the valve timing by the same amount on both cylinder banks (e.g., right and left bank). If the intake valve timing is varied and the exhaust valve timing is fixed, only the intake valve pivot points may be eccentric (e.g., offset from axis of rotation of the pivot shaft). If both the corresponding intake and exhaust valve pivot points are eccentric then both valve timings may vary as the pivot shaft rotates. In one example, both the intake and exhaust timing may advance or retard together. In another example, one of the intake or exhaust timing may advance while the other may retard, depending on the phase or position of the eccentric pivot points in the pivot shaft.

In this way, a cam follower system may enable the adjustment of a valve timing of intake and/or exhaust valves on both a right and left bank of cylinders in a V-engine. The cam follower system may include a single camshaft centralized between the two banks of cylinders and a cam follower coupled through a pushrod to each intake and exhaust valve of each cylinder. The cam followers may be driven by the camshaft, actuating the valves as a cam lobe on the camshaft contacts one end of the cam follower. Each cam follower may be coupled at another end to an eccentric pivot point on a pivot shaft. The pivot points may be offset from a main axis of the pivot shaft. As such, rotating the pivot shaft may translate the position of the pivot points, thereby shifting the position of the cam followers and the point at which they contact the camshaft. This shifting the position of the cam followers may adjust the valve timing. Depending on the amount of pivot points and the location of the pivot points relative to the pivot shaft, the timing of the intake and/or exhaust valves may be adjusted by rotating a single pivot shaft. In one example, a controller may adjust the pivot shaft to adjust valve timing based on engine operating conditions such as engine load. In this way, valve timing may be adjusted based on engine load to increase engine efficiency and reduce emissions.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method, comprising:

pivoting a first cam follower for a first cylinder of a first bank and a second cam follower for a second cylinder of a second bank about a rotatable pivot shaft;

driving the first cam follower and the second cam follower with a camshaft to operate a respective first valve of the first cylinder and a second valve of the second cylinder; and rotating the pivot shaft to vary one or more valve timings of the first cylinder and the second cylinder.

2. The method of claim 1, wherein the rotating the pivot shaft includes rotating the pivot shaft in a first direction to advance the valve timing of the first and second cylinder, and rotating the pivot shaft in a second, opposite direction, to retard the valve timing of the first and second cylinder, wherein the rotating the pivot shaft to vary the one or more valve timings includes rotating the pivot shaft to shift a first position of a first roller of the first cam follower on the camshaft and shift a second position of a second roller of the second cam follower on the camshaft, and wherein driving the first cam follower and the second cam follower with the camshaft to operate the respective first valve of the first cylinder and the second valve of the second cylinder includes actuating the first valve through a first pushrod attached to the first roller as a first cam lobe on the camshaft contacts the first roller and actuating the second valve through a second pushrod attached to the second roller as a second cam lobe on the camshaft contacts the second roller.

3. The method of claim 1, wherein the rotating the pivot shaft includes rotating the pivot shaft about a first lateral axis, the first lateral axis positioned vertically above a second lateral axis of rotation of the camshaft, the first lateral axis and the second lateral axis positioned along a vertical centerline separating the first bank and the second bank, the first bank and the second bank forming a V-engine.

4. The method of claim 3, wherein the pivoting includes translating a first pivot point and a second pivot point on the pivot shaft away from the centerline, the first pivot point coupled to a first end of the first cam follower and the second pivot point coupled to a first end of the second cam follower.

5. The method of claim 4, wherein the translating the first pivot point includes moving a first contact point between a first roller coupled to a second end of the first cam follower and the camshaft, relative to a cam lobe on the camshaft, and the translating the second pivot point includes moving a second contact point between a second roller coupled to a second end of the second cam follower and the camshaft, relative to the cam lobe on the camshaft.

6. The method of claim 5, further comprising moving the first contact point of the first cam follower towards the vertical centerline on the camshaft to advance the valve timing of the first valve and moving the second contact point of the second cam follower away from the vertical centerline to advance the valve timing of the second valve.

7. The method of claim 1, wherein the pivot shaft is a first pivot shaft controlling the valve timing of the first valve and the second valve, the first valve and the second valve comprising intake valves.

8. The method of claim 7, further comprising adjusting valve timing of an exhaust valve with a second pivot shaft having a third lateral axis positioned vertically above the first lateral axis of the first pivot shaft.

9. A system, comprising:

a V-engine with a single, central camshaft;

a first rotatable pivot shaft offset from the camshaft;

a first group of cam followers operative to be driven by the camshaft and pivoted about the first rotatable pivot shaft;

a first group of pushrods operative to drive valves of a first cylinder group, the first group of pushrods operatively coupled with the first group of cam followers;

a second group of cam followers operative to be driven by the camshaft and pivoted about the first rotatable pivot shaft; and a second group of pushrods operative to drive valves of a second cylinder group, the second group of pushrods operatively coupled with the second group of cam followers.

10. The system of claim 9, wherein the valves of the first cylinder group comprise a first group of intake valves and first group of exhaust valves, the first group of pushrods are operative to drive the first group of intake valves and the first group of exhaust valves, the valves of the second cylinder group comprise a second group of intake valves and a second group of exhaust valves, and the second group of pushrods are operative to drive the second group of intake valves and the second group of exhaust valves.

11. The system of claim 9, wherein an axis of rotation of the first rotatable pivot shaft is located vertically above an axis of rotation of the camshaft, both axes laterally positioned in the V-engine, wherein a first group of rollers of the first group of cam followers contact the camshaft opposite the first group of pushrods, and wherein a second group of rollers of the second group of cam followers contact the camshaft opposite the second group of pushrods.

12. The system of claim 11, wherein the first group of cam followers and the second group of cam followers pivot about eccentric pivot points on the first rotatable pivot shaft, the eccentric pivot points eccentrically positioned with respect to the axis of rotation of the first rotatable pivot shaft.

13. The system of claim 12, wherein the eccentric pivot points of the first rotatable pivot shaft comprise a first group of eccentric pivot points offset from the axis of rotation of the first rotatable pivot shaft and a second group of eccentric pivot points offset from the axis of rotation of the first rotatable pivot shaft, the first group of cam followers being rotatable about the first group of eccentric pivot points, and the second group of cam followers being rotatable about the second group of eccentric pivot points, the first group of eccentric pivot points and the second group of eccentric pivot points offset in different directions from the axis of rotation.

14. The system of claim 13, wherein the first group of eccentric pivot points are coupled through the first group of pushrods to the first group of intake valves of the first cylinder group and the second group of eccentric pivot points are coupled through the second group of pushrods to the second group of intake valves of the second cylinder group, wherein a contact point of the first group of rollers on an outer surface of the camshaft is based on a position of the first group of eccentric pivot points, the position of the first group of eccentric pivot points translatable, relative to a vertical and horizontal axis of the first rotatable pivot shaft, with rotation of the first rotatable pivot shaft, and wherein a contact point of the second group of rollers on the outer surface of the camshaft is based on a position of the second group of eccentric pivot points, the position of the second group of eccentric pivot points translatable, relative to the vertical and horizontal axis of the first rotatable pivot shaft, with rotation of the first rotatable pivot shaft.

15. The system of claim 14, wherein the eccentric pivot points of the first rotatable pivot shaft further comprise a third group of eccentric pivot points operative to drive the first group of exhaust valves of the first cylinder group and a fourth group of eccentric pivot points operative to drive the second group of exhaust valves of the second cylinder group.

16. The system of claim 14, further comprising a second rotatable pivot shaft positioned vertically above the axis of rotation of the first rotatable pivot shaft, the second rotatable pivot shaft having a lateral axis of rotation.

17. The system of claim 16, wherein the second rotatable pivot shaft has a fifth group of eccentric pivot points offset from the axis of rotation of the second pivot shaft and a sixth group of eccentric pivot points offset from the axis of rotation of the second pivot shaft, the system further comprising a third group of cam followers being rotatable about the fifth group of eccentric pivot points, the third group of cam followers driving the first group of exhaust valves of the first cylinder group, and a fourth group of cam followers being rotatable about the sixth group of eccentric pivot points, the fourth group of cam followers driving the second group of exhaust valves of the second cylinder group.

18. The system of claim 14, further comprising a cam phaser coupled to the camshaft for varying a cam timing relative to crank timing.

19. The system of claim 9, wherein the pivot shaft is mounted in an eccentric bushing, the eccentric bushing rotatable separately from the pivot shaft.

20. A system, comprising:

a V-engine with a single, central camshaft, the camshaft with a first axis of rotation in a lateral direction;

a rotatable pivot shaft with a second axis of rotation positioned vertically above the first axis of rotation of the camshaft;

a first group of cam followers configured to pivot about the rotatable pivot shaft at a first end of the first group of cam followers and contacting the camshaft at a second end of the first group of cam followers;

a first group of pushrods operative to drive valves of a first cylinder group, the first group of pushrods operatively coupled to the first group of cam followers at the second end;

a second group of cam followers configured to pivot about the rotatable pivot shaft at a first end of the second group of cam followers and contacting the camshaft at a second end of the second group of cam followers; and a second group of pushrods operative to drive valves of a second cylinder group, the second group of pushrods operatively coupled to the second group of cam followers at the second end.

* * * * *